US010649378B2

(12) United States Patent
Okajima

(10) Patent No.: US 10,649,378 B2
(45) Date of Patent: May 12, 2020

(54) FIXING DEVICE AND IMAGE FORMING APPARATUS

(71) Applicant: KYOCERA Document Solutions Inc., Osaka (JP)

(72) Inventor: Yasuhito Okajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/399,220

(22) Filed: Apr. 30, 2019

(65) Prior Publication Data

US 2019/0346797 A1 Nov. 14, 2019

(30) Foreign Application Priority Data

May 8, 2018 (JP) ..... 2018-090021

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2025; G03G 15/2053; G03G 15/2064; G03G 2215/2035
See application file for complete search history.

(56) References Cited

U.S. PATENT DOCUMENTS

2004/0265020 A1* 12/2004 Aruga ..... G03G 15/2053 399/329
2011/0064493 A1* 3/2011 Muramatsu ..... G03G 15/2064 399/329
2013/0315637 A1* 11/2013 Sato ..... G03G 15/2053 399/329
2015/0043953 A1* 2/2015 Nakamoto ..... G03G 15/2025 399/329
2016/0179043 A1* 6/2016 Kawaguchi ..... G03G 15/2053 399/329
2016/0246231 A1* 8/2016 Noya ..... G03G 15/206
2016/0313677 A1* 10/2016 Oyama ..... G03G 15/1615

FOREIGN PATENT DOCUMENTS

JP 2002169396 A 6/2002

* cited by examiner

*Primary Examiner* — Francis C Gray
(74) *Attorney, Agent, or Firm* — Studebaker & Brackett PC

(57) ABSTRACT

A fixing device includes a fixing belt, a pressing member, a pressing roller and a cap. The fixing belt is cylindrical and rotatable. The pressing member has a longitudinal length shorter than a longitudinal length of the fixing belt. The pressing member is configured to face an inner circumferential face of the fixing belt via a lubricant. The cap is configured to rotate together with the fixing belt. In a first end area between the longitudinal end portion of the fixing belt and the pressing member, a first step is formed on the inner circumferential face of the fixing belt in a circumferential direction of the fixing belt such that an inner diameter of the fixing belt is larger at a side of the longitudinal end than at a side of the pressing member.

6 Claims, 10 Drawing Sheets

FIXING DEVICE AND IMAGE FORMING APPARATUS

INCORPORATION BY REFERENCE

This application is based on and claims the benefit of priority from Japanese Patent application No. 2018-090021, filed on May 8, 2018, which is incorporated by reference in its entirety.

BACKGROUND

The present disclosure relates to a fixing device configured to fix a toner image on a sheet and an image forming apparatus provided with the fixing device.

As one of techniques to fix a toner on a sheet, a sliding belt type fixing technique is known. A fixing device of this technique includes a rotatable cylindrical fixing belt, a pressing pad facing an inner circumferential face of the fixing belt, a pressing roller putting the fixing belt between the pressing pad and the pressing roller and a heating means to heat the fixing belt. When the pressing roller is driven to be rotated, the fixing belt is driven to be rotated and slid with respect to the pressing pad. The sheet on which the toner is transferred is put between the fixing belt and the pressing roller and conveyed, and the toner is fixed on the sheet. Sometimes, a flat heater having both functions of the pressing pad and the heating means is provided. On the inner circumferential face of the fixing belt, a lubricant is applied in order to reduce friction to the pressing pad.

In the above described configuration, as the pressing pad, the fixing belt and the pressing roller are abraded or deteriorated, a slip between the fixing belt and the pressing roller may occur. When a rotation speed of the fixing belt is decreased owing to the slip, the fixing belt may be abnormally heated locally and may be deformed. In order to prevent the occurrence of such a problem, a measure to detect the rotation of the fixing belt by using a cap attached to an end portion of the fixing belt and to control the heating means depending on the rotation condition is provided.

However, the lubricant applied on the inner circumferential face of the fixing belt may enter between the fixing belt and the cap. Then, a frictional resistance of the fixing belt to the cap is decreased and the cap is not rotated together with the fixing belt. As a result, it becomes impossible to detect the rotation of the fixing belt.

In order to prevent the leakage of the lubricant from the fixing belt, a member made of fluorocarbon rubber is sometimes attached around the entire inner circumferential face of the end portion of the fixing belt.

However, in this case, because the new member is added to the fixing belt, the fixing belt may have a complex structure.

SUMMARY

In accordance with an aspect of the present disclosure, a fixing device includes a fixing belt, a pressing member, a pressing roller and a cap. The fixing belt is cylindrical and rotatable. The pressing member has a longitudinal length shorter than a longitudinal length of the fixing belt. The pressing member is configured to face an inner circumferential face of the fixing belt via a lubricant such that both longitudinal end portions of the pressing member are positioned inside both longitudinal end portions of the fixing belt. The pressing roller is configured to form a pressing area between the pressing member and the pressing roller and to drive the fixing belt to rotate the fixing belt. A sheet being is conveyed through the pressing area. The cap is configured to rotate together with the fixing belt and having a disk-shaped part coming into contact with an end face of the fixing belt and a cylindrical part extending from the disk-shaped part toward a center side of the fixing belt. An inner circumferential face of the cylindrical part faces an outer circumferential face of the fixing belt. In a first end area between the longitudinal end portion of the fixing belt and the pressing member, a first step is formed on the inner circumferential face of the fixing belt in a circumferential direction of the fixing belt such that an inner diameter of the fixing belt is larger at a side of the longitudinal end than at a side of the pressing member.

In accordance with an aspect of the present disclosure, an image forming apparatus includes an image forming part configured to form a toner image on the sheet and the fixing device configured to fix the toner image on the sheet.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus and a fixing device of the present disclosure will be described.

Figure 1:
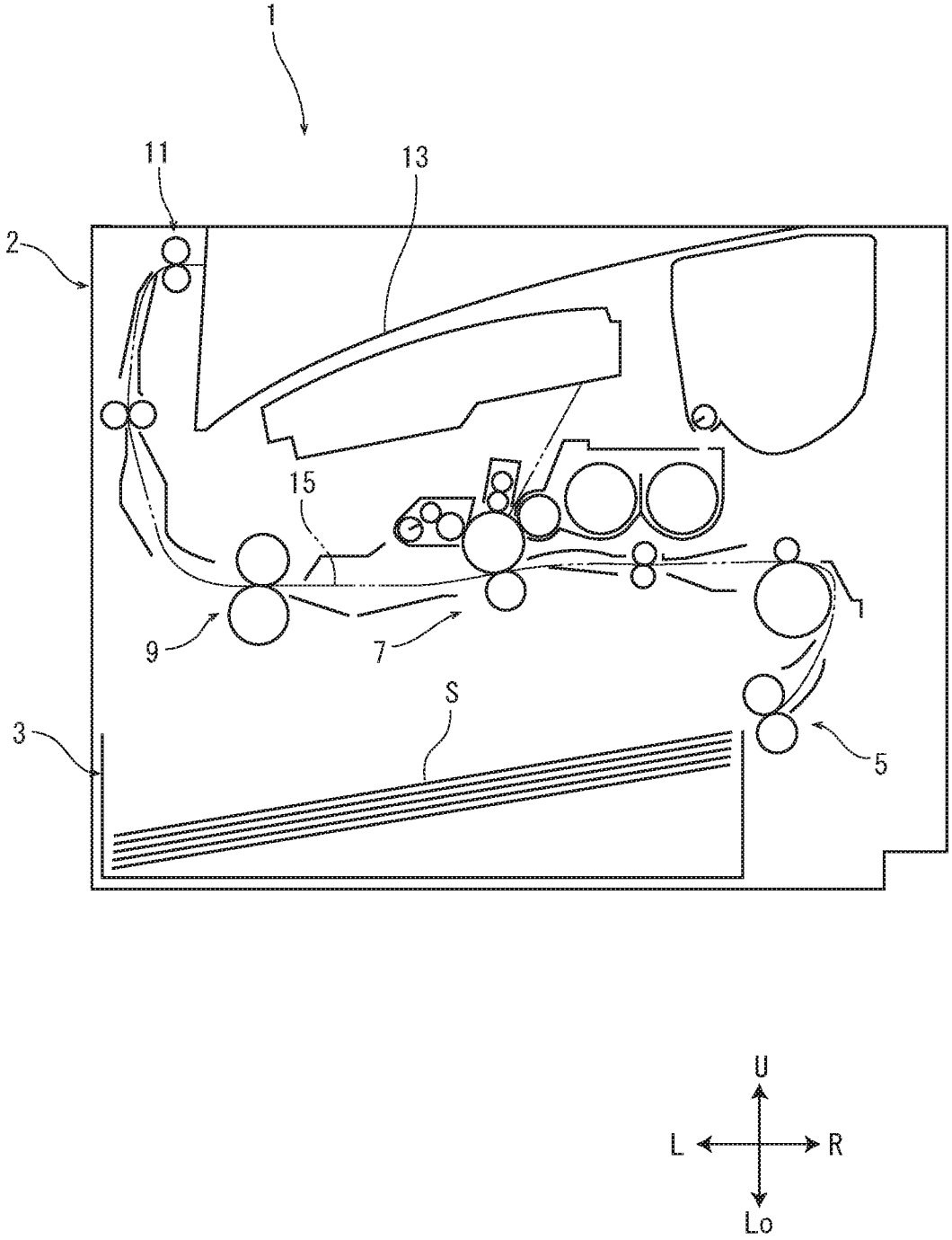
FIG. 1 is a front view showing an entire structure of a printer according to an embodiment of the present disclosure.

First, with reference to FIG. 1, an entire structure of a printer 1 as the image forming apparatus will be described. FIG. 1 is a front view schematically showing an internal structure of the printer 1. In the following description, a near side of a paper surface of FIG. 1 is defined to be a front side of the printer 1, and left and right directions are based on a direction in which the printer 1 is viewed from the front side. "U", "Lo", "L", "R", "Fr" and "Rr" in each figure respectively indicates "an upper side", "a lower side", "a left side", "a right side", "a front side" and "a rear side" of the printer 1.

An apparatus main body 2 of the printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, an ejecting device 11 ejecting the sheet S and an ejected sheet tray 13 on which the ejected sheet S is stacked. In the apparatus main body 2, a conveyance path 15 for the sheet S is formed so as to extend from the sheet feeding device 5 to the ejecting device 11 through the image forming part 7 and the fixing device 9.

The sheet S fed from the sheet feeding cassette 3 by the sheet feeding device 5 is conveyed along the conveyance path 15 to the image forming part 7. At the image forming part 7, the toner image is formed on the sheet S. The sheet S is conveyed along the sheet conveyance path 15 to the fixing device 9. At the fixing device 9, the toner image is fixed on the sheet S. The sheet S on which the toner image is fixed is ejected by the ejecting device 11 on the ejected sheet tray 13.

Figure 2:
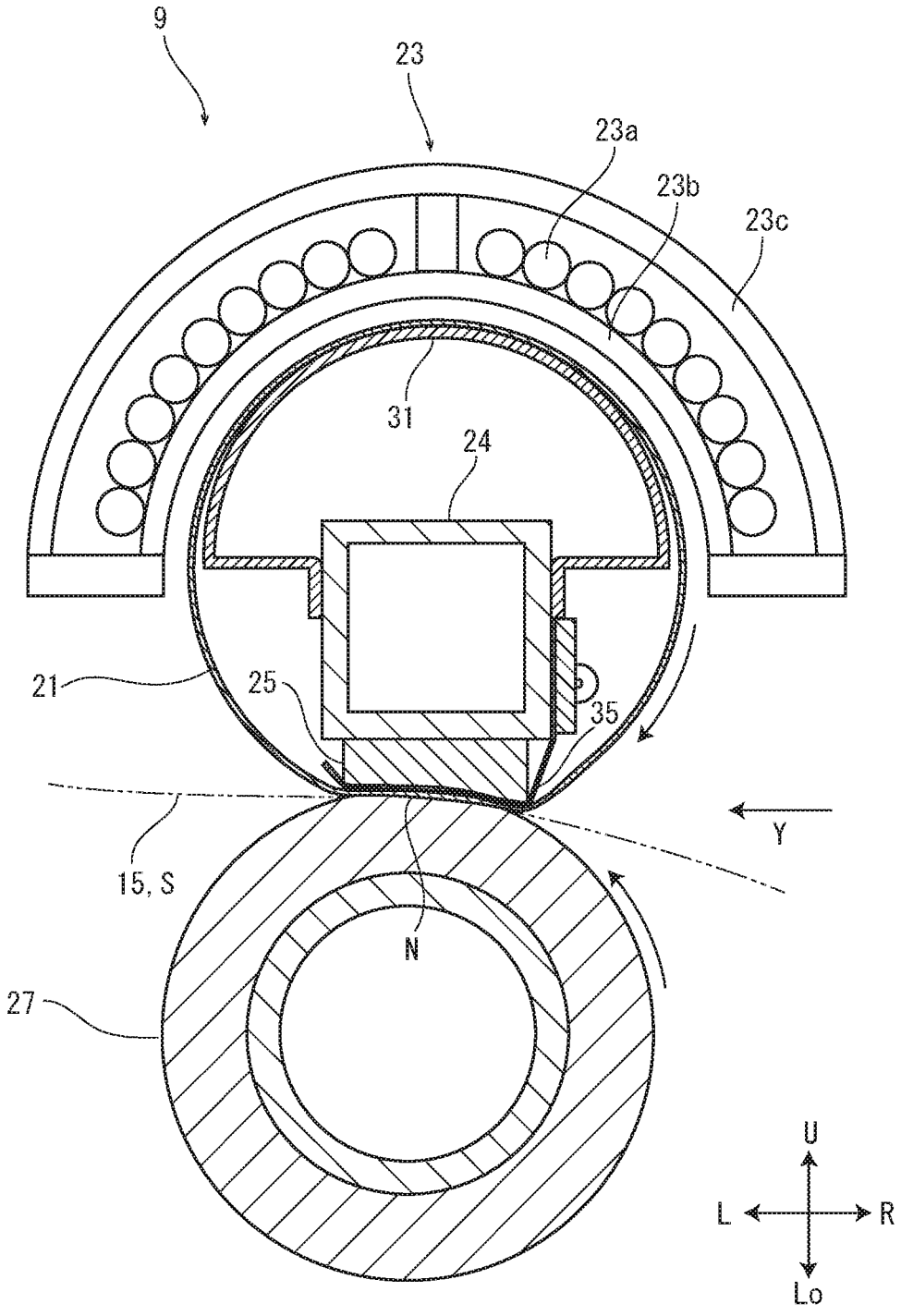
FIG. 2 is a sectional view showing a fixing device according to the embodiment of the present disclosure.
Figure 3:
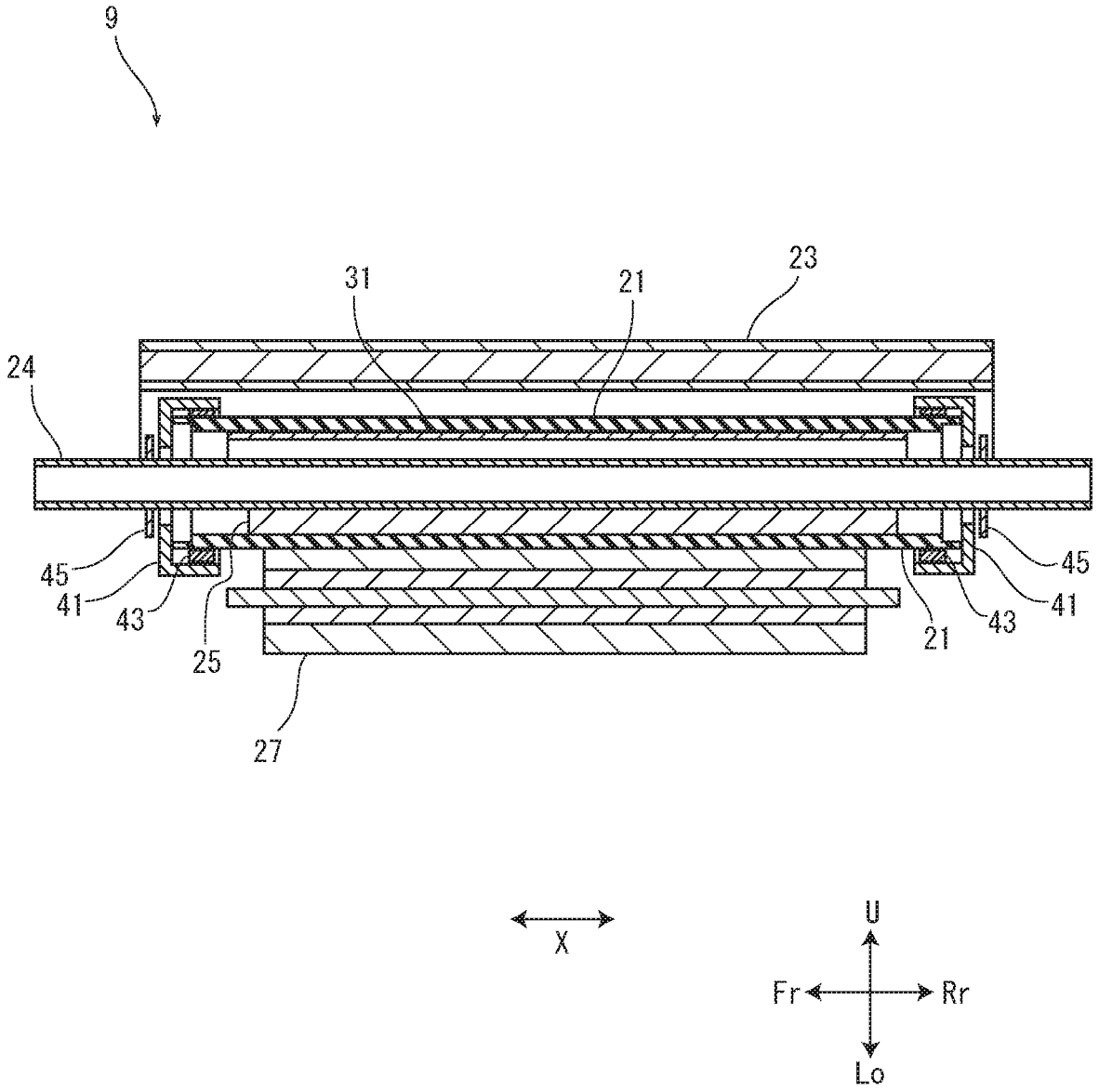
FIG. 3 is a sectional view showing the fixing device according to the embodiment of the present disclosure.
Figure 4:
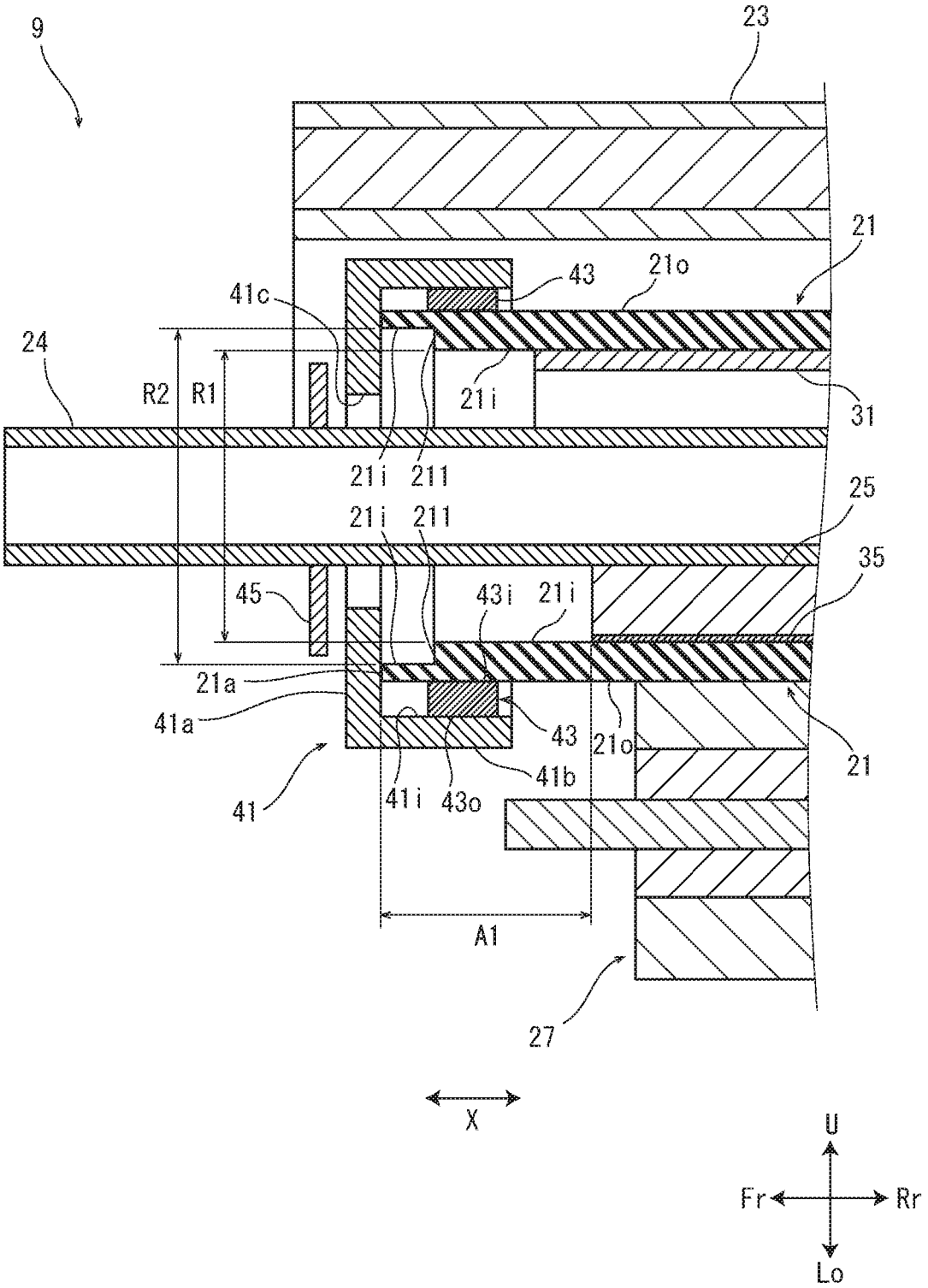
FIG. 4 is a sectional view showing the fixing device according to the embodiment of the present disclosure.
Figure 5:
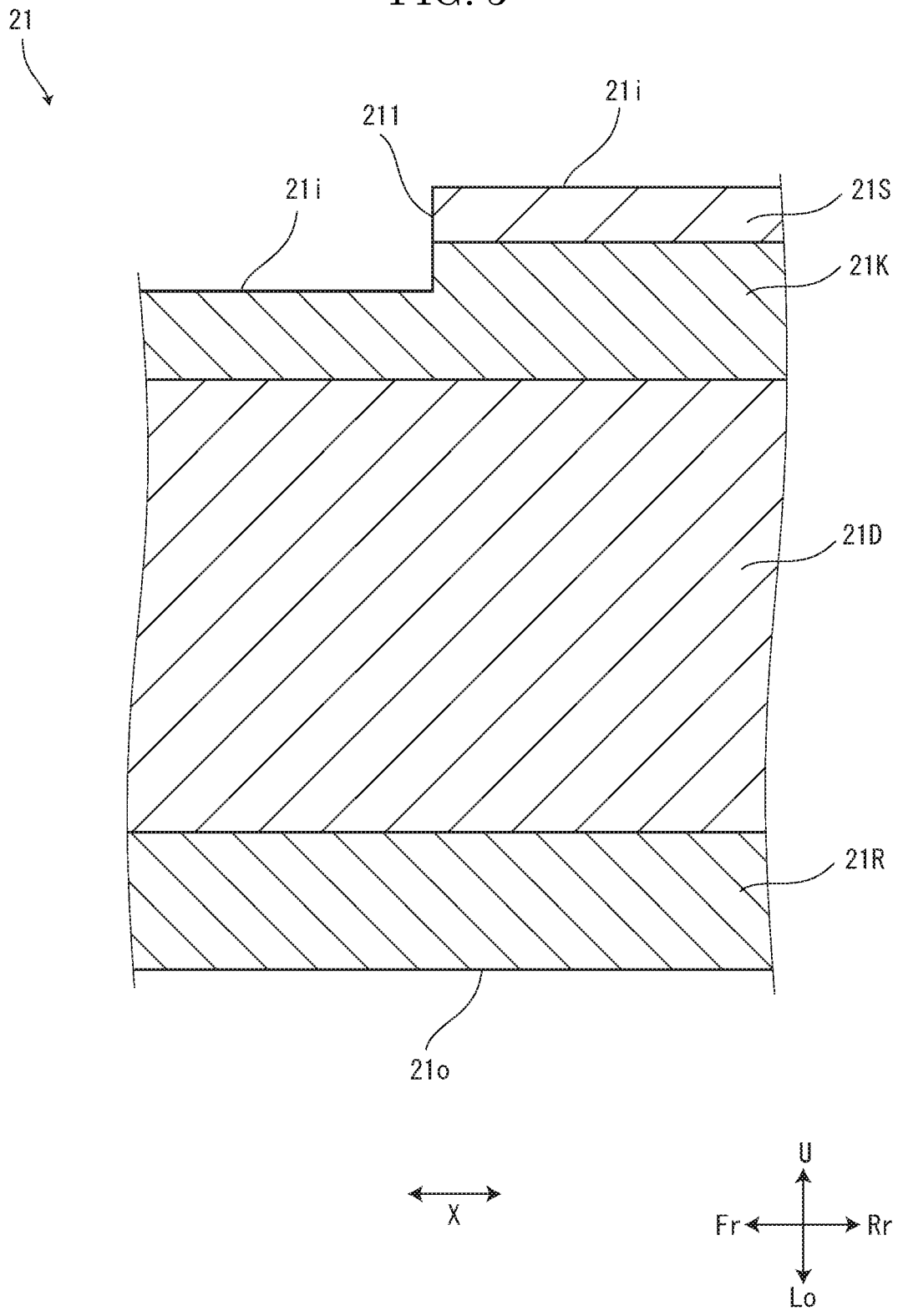
FIG. 5 is a sectional view showing a fixing belt according to the embodiment of the present disclosure.
Figure 6:
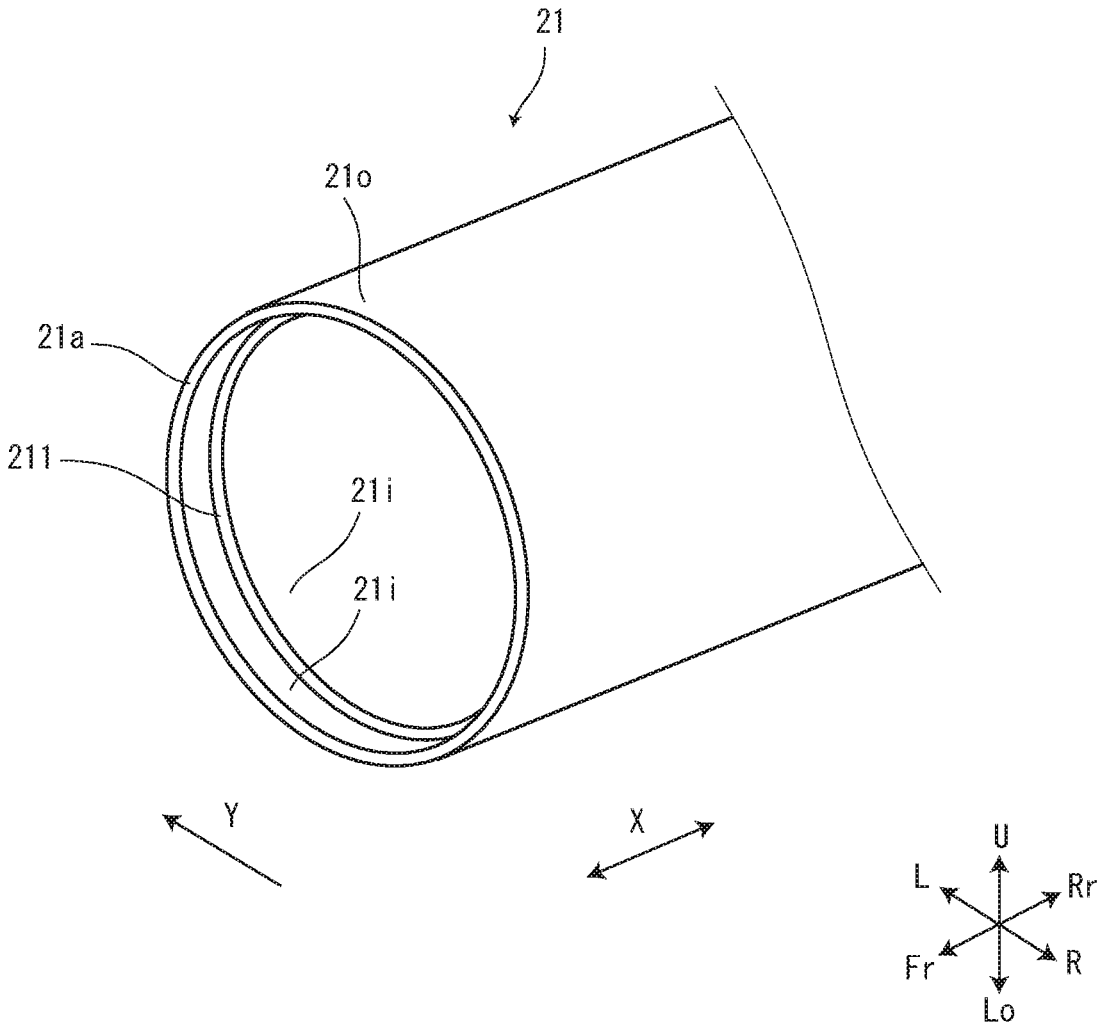
FIG. 6 is a perspective view showing the fixing belt according to the embodiment of the present disclosure.
Figure 7:
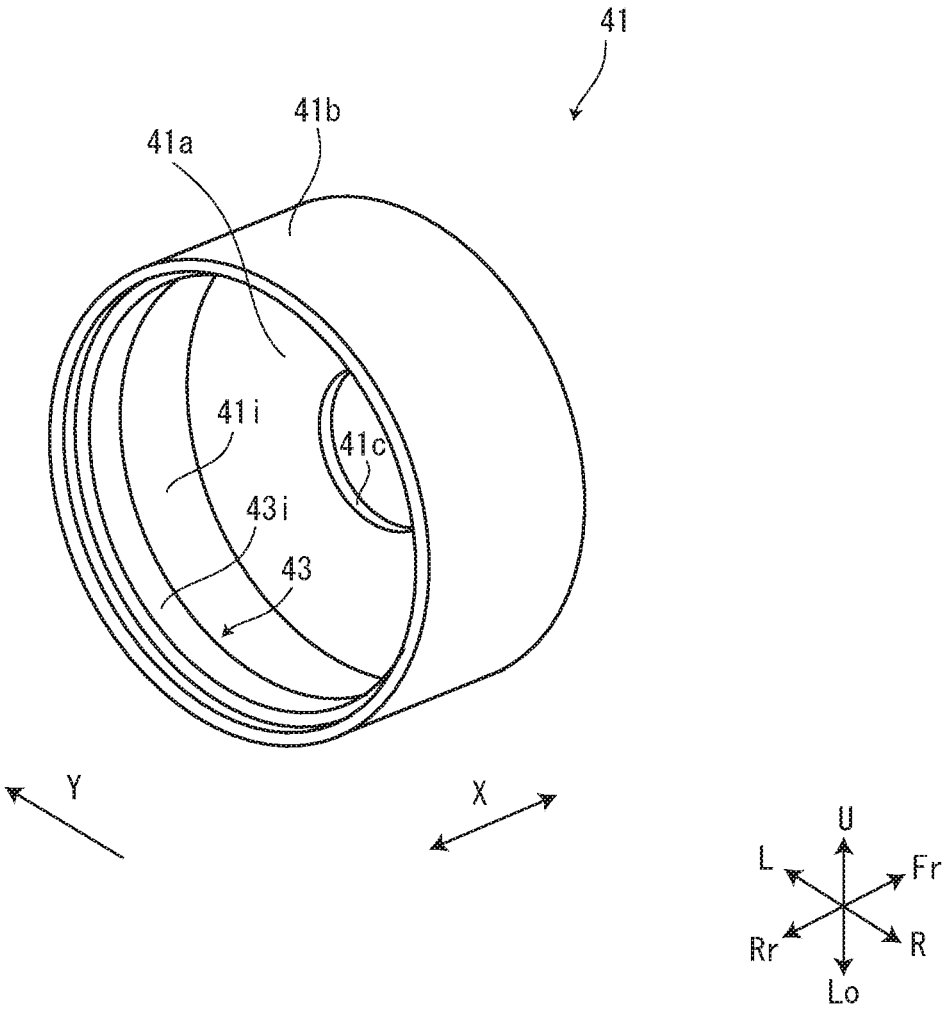
FIG. 7 is a perspective view showing a cap according to the embodiment of the present disclosure.

Next, with reference to FIG. 2 to FIG. 7, a structure of the fixing device 9 will be described. FIG. 2, FIG. 3 and FIG. 4 are sectional views showing the fixing device 9. FIG. 6 is a perspective view showing a fixing belt 21. FIG. 7 is a perspective view showing a cap 41. Here, FIG. 5 is an enlarged view of the lower cross section among the upper cross section and the lower cross section of the fixing belt 21 shown in FIG. 4. A ratio of a length in the upper-and-lower direction of FIG. 5 is different from that of FIG. 4 for convenience for showing them in figure. Furthermore, a ratio in the radial direction of FIG. 4 is different from that of FIG. 5. FIG. 4 to FIG. 7 show each part of the front side portion of the fixing device 9; the rear side portion of the fixing device 9 has the same configuration as that of the front side portion.

The fixing device 9 includes a rotatable cylindrical fixing belt 21, an IH heater 23 (an example of a heating means), a pressing pad 25 (an example of a pressing member), a pressing roller 27 and a cap 41. The IH heater 23 heats the fixing belt 21. The pressing pad 25 faces an inner circumferential face 21*i* of the fixing belt 21. The fixing belt 21 is put between the pressing roller 27 and the pressing pad 25, and a pressing area N through which the sheet S is conveyed is formed between the pressing roller 27 and the fixing belt 21. The fixing belt 21 is driven by the pressing roller 27 to be rotated. The cap 41 is attached to each of front and rear end portions of the fixing belt 21. Hereinafter, an axial direction X shows an axial direction (the front-and-rear direction) of the pressing roller 27. In the present embodiment, the fixing device 9 is arranged in a posture that the pressing roller 27 is positioned below the fixing belt 21; however, the fixing device 9 may be arranged in any posture.

The fixing belt 21 is a cylindrical endless belt long in the axial direction X, and has a predetermined inner diameter and a longitudinal length longer than a width of the sheet S. The fixing belt 21 is made of flexible material. As shown in FIG. 5, the fixing belt 21 has a base layer 21K, an elastic layer 21D provided around an outer circumferential face of the base layer 21K, a release layer 21R provided around an outer circumferential face of the elastic layer 21D and a sliding layer 21S provided around an inner circumferential face of the base layer 21K. The base layer 21K is made of magnetic alloy such as Ni or polyimide resin mixed with metallic powder such as Cu, Ag and Al. The elastic layer 21D is made of silicon rubber. The release layer 21R is made of PFA tube. The sliding layer 21S is made of PTFE or polyimide-amid resin. For example, a thickness of the base layer 21K is 30 to 50 μm in case of the base layer 21K of Ni alloy or 50 to 100 μm in case of the base layer 21K of polyimide resin. A thickness of the elastic layer 21D is 100 to 500 μm. A thickness of release layer 21R is 30 to 50 μm. A thickness of the sliding layer 21S is 10 to 30 μm.

On the inner circumferential face 21*i* of the fixing belt 21, a first step 211 is formed in the circumferential direction of the fixing belt 21. Specifically, as shown in FIG. 4, in a first end area A1 between a longitudinal end face (an end portion) 21*a* of the fixing belt 21 and the pressing pad 25, the first step 211 is formed on the inner circumferential face 21*i* of the fixing bell 21*i* such that an inner diameter R2 at a side of the end face 21*a* is larger than an inner diameter R1 at a side of the pressing pad 25. A height of the first step 211 is 50 to 100 μm. A distance between the first step 211 and the end face 21*a* is 0.5 to 2.0 mm. In an example shown in FIG. 5, the first step 211 is formed such that the base layer 21K is made to be thinner at the side of the end face 21*a* than at the side of the pressing pad 25 and the sliding layer 21S is provided on the inner circumferential face of the base layer 21K at only the side of the pressing pad 25. In this example, the thickness at the side of the end face 21*a* is preferably equal to or larger than a half of the thickness at the side of the pressing pad 25.

As shown in FIG. 4 and FIG. 7, the cap 71 has a disk-shaped part 41*a* and a cylindrical part 41*b*. The disk-shaped part 41*a* comes into contact with the end face 21*a* of the fixing belt 21. The cylindrical part 41*b* extends from the disk-shaped part 41*a* toward a center side of the fixing belt 21, and its inner circumferential face 41*i* faces an outer circumferential face 21*o* of the fixing belt 21 via an elastic member 43. The cap 41 is made of resin such as PPS. At a center of the disk-shaped part 41*a*, a through hole 41*c* penetrating in the front-and-rear direction is formed. The elastic member 43 is an annular member having a rectangular cross section, and made of foamed silicon rubber. An outer circumferential face 43*o* of the elastic member 43 is adhered on the inner circumferential face 41*i* of the cylindrical part 41*b* of the cap 41 by a silicon based double-sided adhesive tape. The cap 41 is rotated together with the rotating fixing belt 21 by a friction resistance of the outer circumferential face 21*o* of the fixing belt 21 to an inner circumferential face 43*i* of the elastic member 43.

The cap 41 is used to detect the rotation of the fixing belt 21. For example, the cap 41 is provided with a light-shielding plate protruding radially from the outer circumferential face of the cylindrical part 41*b* of the cap 41, and a photo interrupter detects a light shielded by the light-shielding plate. When a frequency of light shielding period detected by the photo interrupter exceeds a threshold value, a controller of the printer 1 controls the IH heater 23 to stop the heating or to decrease a heating amount (not shown).

As shown in FIG. 2 to FIG. 4, the fixing belt 21 is supported by a stay 24 and a belt guide 31. The stay 24 is a rectangular cylindrical member long in the axial direction X, and has a longitudinal length longer than the longitudinal length of the fixing belt 21. The stay 24 penetrates through an inner space of the fixing belt 21 and the through holes 41*c* of the caps 41, and its both end portions are fixed to a housing (not shown). On an upper portion of the stay 24, the belt guide 31 is disposed. The belt guide has an arc-shaped cross section around the inner circumferential face 21*i* of the fixing belt 21, and is made of Fe—Ni alloy. The belt guide 31 comes into contact with the inner circumferential face 21*i* of the fixing belt 21 and supports the fixing belt 21 so as to be rotated stably.

As shown in FIG. 3 and FIG. 4, at an outside of the cap 41 in the axial direction X, a stopper 45 is mounted to the stay 24. The stopper 45 is a plate-shaped member having a diameter larger than an outer diameter of the through hole 41*c* of the cap 41, and restricts the movement of the cap 41 in the front-and-rear direction.

The IH heater 23 includes a coil part 23*a*, a coil bobbin 23*b* which holds the coil part 23*a* in a winding posture and an arch core 23*c*. The IH heater 23 is arranged so as to cover the outer circumferential face 21*o* of the fixing belt 21 via a predetermined gap, and supported by the housing. By applying high frequency alternating current voltage on the coil part 23*a*, magnetic field is produced. Owing to the magnetic field, eddy current is produced in the base layer 21K of the fixing belt 21 and then the base layer 21K is heated to heat the fixing belt 21. The belt guide 31 is heated by the magnetic field produced by the coil part 23*a* and secondarily heats the fixing belt 21.

The pressing pad 25 is a shallow parallelepiped member long in the axial direction X, and made of resin such as liquid crystal polymer. The pressing pad 25 is disposed on a lower portion of the stay 24. The pressing pad 25 has a longitudinal length shorter than the longitudinal length of the fixing belt 21, and is arranged such that its longitudinal end portions are inside the longitudinal end portions of the fixing belt 21. As shown in FIG. 2 and FIG. 4, a lower face of the pressing pad 25 is covered with a sheet-shaped sliding member 35, and the pressing pad 25 faces the inner circumferential face 21*i* of the fixing belt 21 via the sliding member 35. The sliding member 35 is made of fluorine-based material, and decreases a sliding load to the fixing belt 21. An elastomer may be arranged on a lower face side of the pressing pad 25.

The pressing roller 27 has a shaft, a core metal, an elastic layer provided around an outer circumferential face of the core metal and a release layer provided around an outer circumferential face of the elastic layer. The core metal, the elastic layer and the release layer each have a length in the axial direction X shorter than the length of the fixing belt 21 in the axial direction X. Both end portions of the shaft are protruded from both end portions of the core metal in the axial direction X. The shaft and the core metal are made of metal such as stainless steel and A1 alloy. The elastic layer is made of silicon rubber. Th release layer is made of PFA tube. To the shaft of the pressing roller 27, driving force is transmitted from a drive source (not shown), such as a motor, via a transmitting mechanism (not shown), such as a gear. The pressing roller 27 and the pressing pad 25 are pressed each other at a predetermined load while putting the fixing belt 21 between the pressing roller 27 and the fixing belt 21 to form the pressing area N between the pressing roller 27 and the fixing belt 21.

Next, with reference to FIG. 2, a fixing operation of the fixing device 9 will be described. When the pressing roller 27 is driven to be rotated, the fixing belt 21 is driven by the pressing roller 27 to be rotated in a counter direction to a rotation direction of the pressing roller 27 and slid with respect to the sliding member 35. When electric power is supplied to the IH heater 23, the base layer 21K of the fixing belt 21 is heated to heat the fixing belt 21. After the fixing belt 21 is heated to a predetermined temperature, the sheet S on which the toner is transferred is conveyed to the pressing area N. At the pressing area N, the sheet S is put between the fixing belt 21 and the pressing roller 27 and then conveyed in a predetermined conveyance direction Y. At this time, the toner is heated and pressed by the fixing belt 21 to be fixed on the sheet S. The sheet S on which the toner is fixed is separated from the fixing belt 21 and then conveyed along the conveyance path 15.

Figure 8:
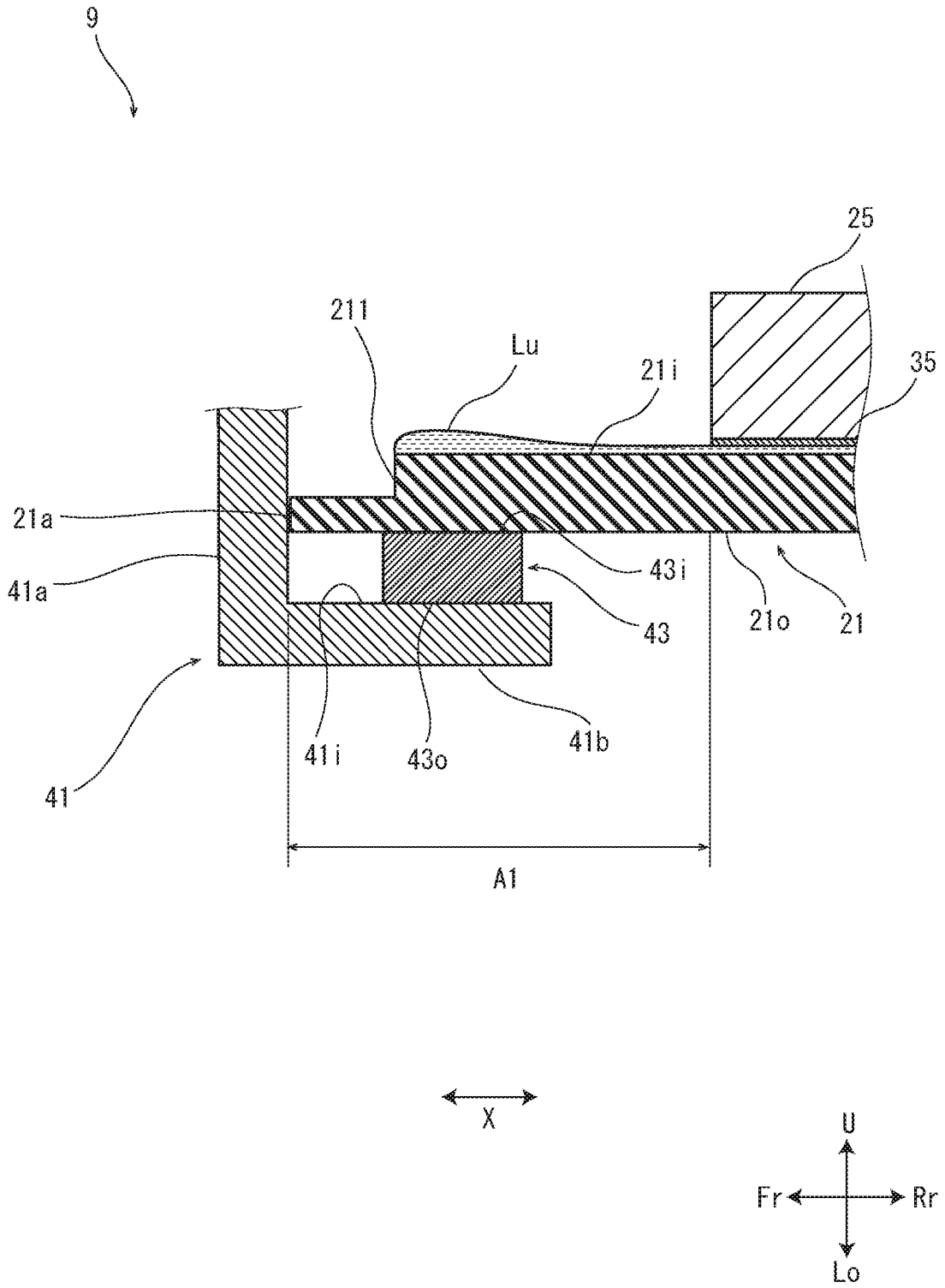
FIG. 8 is a sectional view showing a first step and its peripheral portion according to the embodiment of the present disclosure.

In a conventional configuration that the fixing belt 21 does not have the first step 211 on the inner circumferential face 21*i*, the lubricant applied on the inner circumferential face 21*i* of the fixing belt 21 may enter between the fixing belt 21 and the cap 41. Then, the frictional resistance of the fixing belt 21 to the elastic member 43 is decreased, and the cap 41 is not rotated together with the fixing belt 21. As a result, it becomes impossible to detect the rotation of the fixing belt 21. In contrast, in the present embodiment, because the fixing belt 21 has the first step 211 on the inner circumferential face 21*i*, as shown in FIG. 8 (the sectional view showing the first step 211 and its periphery), the lubricant Lu is kept on the inner circumferential face 21*i* at the side of the pressing pad 25 without going through the first step 211 by its surface tension. Accordingly, according to the present embodiment, it becomes possible to prevent the lubricant from being entered between the fixing belt 21 and the cap 41 without adding a new member.

Modified Example

Figure 9:
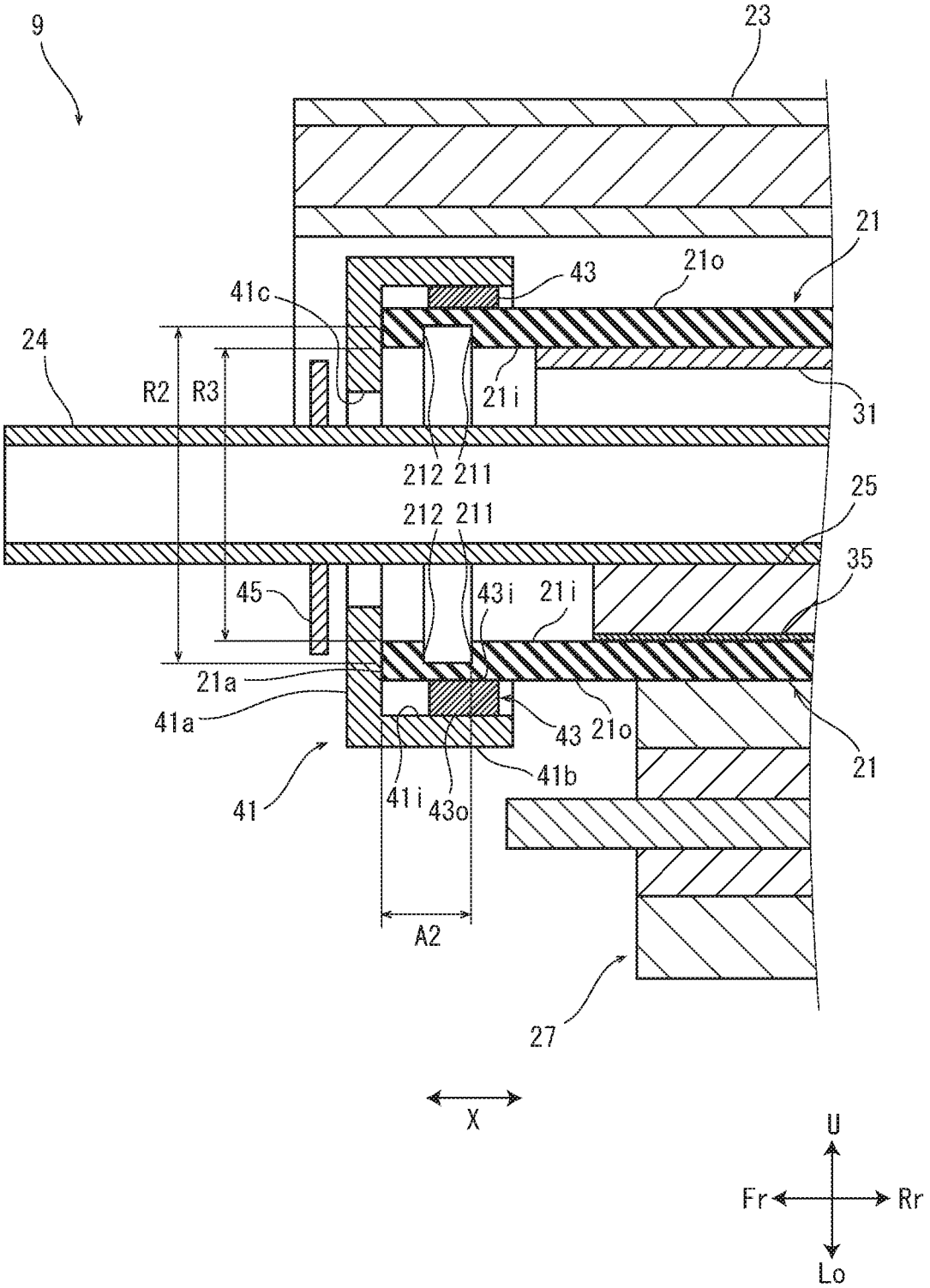
FIG. 9 is a sectional view showing the fixing device according to the embodiment of the present disclosure.

The above embodiment may be modified as shown in FIG. 9. FIG. 9 is a sectional view showing the fixing device 9. In the example, the fixing belt 21 has a second step 212 in addition to the first step 211. Specifically, in a second end area A2 between the end face 21*a* of the fixing belt 21 and the first step 211, the second step 212 is formed on the inner circumferential face 21*i* of the fixing belt 21 in the circumferential direction of the fixing belt 21 such that an inner diameter R3 at the side of the end face 21*a* is smaller than the inner diameter R2 at the side of the pressing pad 25. According to the configuration, even if the lubricant may go through the first step 211, the lubricant is blocked by the second step 212. Accordingly, compared with a case where the fixing belt 21 has only the first step 211, an effect to prevent the lubricant from being entered between the fixing belt 21 and the cap 41 is improved.

Figure 10:
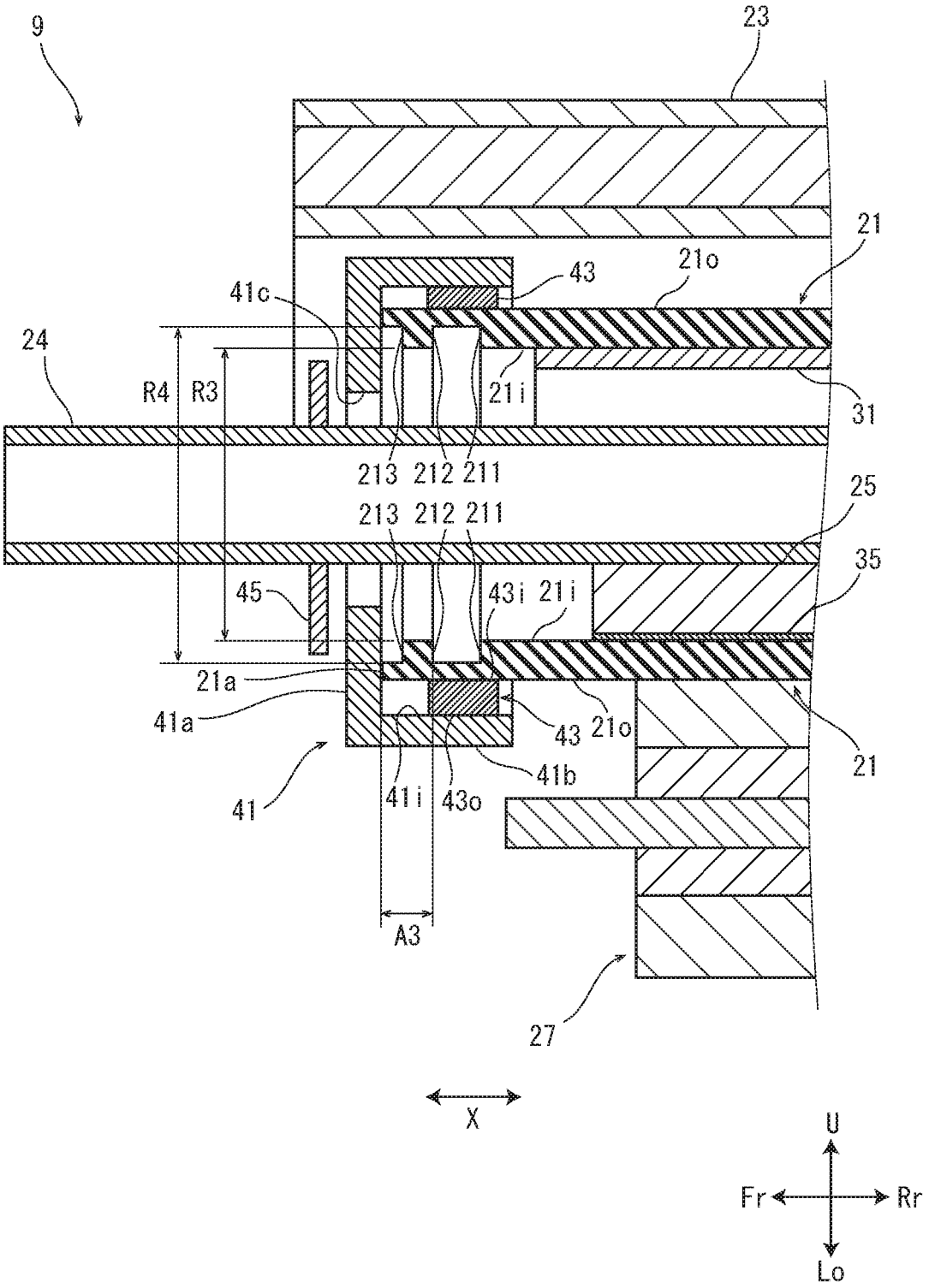
FIG. 10 is a sectional view showing the fixing device according to the embodiment of the present disclosure.

The above embodiment may be modified as shown in FIG. 10. FIG. 10 is a sectional view showing the fixing device 9. In the example, the fixing belt 21 has a third step 213 in addition to the first step 211 and the second step 212. Specifically, in a third end area A3 between the end face 21*a* of the fixing belt 21 and the second step 212, the third step 213 is formed on the inner circumferential face 21*i* of the fixing belt 21 in the circumferential direction of the fixing belt 21 such that an inner diameter R4 at the side of the end face 21*a* is larger than the inner diameter R3 at the side of the pressing pad 25. According to the configuration, even if the lubricant may go through the second step 212, the lubricant is kept on the inner circumferential face 21*i* at the side of the pressing pad 25 without going through the third step 213 by its surface tension. Accordingly, compared with a case where the fixing belt 21 has the first step 211 and the second step 212, an effect to prevent the lubricant from being entered between the fixing belt 21 and the cap 41 is more improved.

The first step 211 may be formed such that the base layer 21K is made to have a uniform thickness and the thickness of the sliding layer 21S is made to be thicker at the side of the end face 21*a* than at the side of the pressing pad 25. Alternatively, the first step 211 may be formed such that the base layer 21K is made to have a uniform thickness and the sliding layer 21S is formed only at the side of the pressing pad 25.

In place of the pressing pad 25 and the IH heater 23, a flat heater may be used.

The inner circumferential face 41*i* of the cylindrical part 41*b* of the cap 41 may come into contact with the outer circumferential face 21*o* of the fixing belt 21 without providing the elastic member 43. The lower face of the pressing pad 25 may come into contact with the inner circumferential face 21*i* of the fixing belt 21 without providing the sliding member 35.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A fixing device comprising:

a rotatable cylindrical fixing belt;

a pressing member having a longitudinal length shorter than a longitudinal length of the fixing belt and configured to face an inner circumferential face of the fixing belt via a lubricant such that both longitudinal end portions of the pressing member are positioned inside both longitudinal end portions of the fixing belt;

a pressing roller configured to form a pressing area between the pressing member and the pressing roller and to drive the fixing belt to rotate the fixing belt, a sheet being conveyed through the pressing area; and a cap configured to rotate together with the fixing belt and having a disk-shaped part coming into contact with an end face of the fixing belt and a cylindrical part extending from the disk-shaped part toward a center side of the fixing belt, an inner circumferential face of the cylindrical part facing an outer circumferential face of the fixing belt, wherein in a first end area between the longitudinal end portion of the fixing belt and the pressing member, a first step is formed on the inner circumferential face of the fixing belt in a circumferential direction of the fixing belt such that an inner diameter of the fixing belt is larger at a side of the longitudinal end than at a side of the pressing member.

2. The fixing device according to claim 1, wherein in a second end area between the longitudinal end portion of the fixing belt and the first step, a second step is formed on the inner circumferential face of the fixing belt in the circumferential direction of the fixing belt such that the inner diameter of the fixing belt is smaller at the side of the longitudinal end than at the side of the pressing member.

3. The fixing device according to claim 2, wherein in a third end area between the longitudinal end portion of the fixing belt and the second step, a third step is formed on the inner circumferential face of the fixing belt in the circumferential direction of the fixing belt such that the inner diameter of the fixing belt is larger at the side of the longitudinal end than at the side of the pressing member.

4. The fixing device according to claim 1, wherein the fixing belt has a base layer made of material containing metal and an elastic layer provided around an outer circumferential face of the base layer, and the step is formed by changing a thickness of the base layer.

5. The fixing device according to claim 1, wherein the step is formed perpendicularly to a thickness direction of the fixing belt.

6. An image forming apparatus comprising:

an image forming part configured to form a toner image on the sheet, and the fixing device according to claim 1, configured to fix the toner image on the sheet.

* * * * *